US007909375B2

(12) United States Patent
Waldman et al.

(10) Patent No.: US 7,909,375 B2
(45) Date of Patent: Mar. 22, 2011

(54) COMBINATION BREADING TONGS AND DIPPING TOOL

(75) Inventors: Lynn Waldman, Inverness, IL (US); Jaclyn Jones, Chicago, IL (US); William Lupkes, Naperville, IL (US); Therese Araiza, Cary, IL (US); Lawrence Michael Hauser, Federal Way, WA (US)

(73) Assignee: Columbia Insurance Company, Omaha, NE (US)

( * ) Notice: Subject to any disclaimer, the term of this patent is extended or adjusted under 35 U.S.C. 154(b) by 782 days.

(21) Appl. No.: 11/848,734

(22) Filed: Aug. 31, 2007

(65) Prior Publication Data

US 2009/0056561 A1 Mar. 5, 2009

(51) Int. Cl.
*B25B 7/00* (2006.01)
*A47G 21/10* (2006.01)

(52) U.S. Cl. ..... 294/3; 294/16; 294/99.2

(58) Field of Classification Search ..... 294/3, 8.5, 294/11, 16, 99.2; 7/110; 24/508, 67.7
See application file for complete search history.

(56) References Cited

U.S. PATENT DOCUMENTS

| | | | | | |
|---|---|---|---|---|---|
| 27,802 | A | | 4/1860 | Hills | |
| 319,226 | A | * | 6/1885 | Goff | 294/3 |
| 1,006,460 | A | * | 10/1911 | Brethour | 294/3 |
| 1,117,740 | A | * | 11/1914 | Witt | 294/25 |
| 1,795,256 | A | | 3/1931 | Johnson | |
| 2,205,379 | A | | 6/1940 | Agostineto | |
| D144,310 | S | | 4/1946 | Moore | |
| 2,397,823 | A | * | 4/1946 | Walter | 606/207 |
| D149,817 | S | | 6/1948 | Jackson | |
| 2,801,877 | A | | 8/1957 | Hetrick | |
| 3,841,684 | A | * | 10/1974 | Fleishman | 294/1.3 |
| 3,937,510 | A | | 2/1976 | Lew | |
| 4,103,395 | A | | 8/1978 | Latorella | |
| D264,169 | S | | 5/1982 | Guttman | |
| D277,446 | S | | 2/1985 | Hollinshead | |
| D285,518 | S | | 9/1986 | Hollinshead | |
| 4,663,806 | A | | 5/1987 | Mangum | |
| D298,398 | S | | 11/1988 | Trahar | |
| 5,054,226 | A | * | 10/1991 | Hart | 43/4 |
| 5,217,464 | A | * | 6/1993 | McDonald | 606/107 |
| 5,385,376 | A | | 1/1995 | Malaspina et al. | |
| 5,439,012 | A | | 8/1995 | D'Agostino | |
| 5,588,689 | A | * | 12/1996 | Ochs | 294/118 |
| 6,056,338 | A | | 5/2000 | Kerr | |
| 6,089,631 | A | | 7/2000 | Thurlow et al. | |
| 6,092,847 | A | | 7/2000 | Kwan | |
| 6,536,819 | B2 | | 3/2003 | Wang et al. | |
| 6,869,117 | B1 | | 3/2005 | Blum | |
| 2001/0045753 | A1 | | 11/2001 | Lewis | |
| 2005/0145733 | A1 | | 7/2005 | Silver et al. | |
| 2005/0253404 | A1 | | 11/2005 | Kerr et al. | |

OTHER PUBLICATIONS

The International Search Report and Written Opinion of the International Searching Authority dated Nov. 5, 2008 for PCT Application PCT/US08/74232.

* cited by examiner

*Primary Examiner* — Dean J Kramer
(74) *Attorney, Agent, or Firm* — Neal Gerber Eisenberg LLP

(57) ABSTRACT

A kitchen utensil includes a handle having a dipping utensil at one end and a gripping surface at a second end thereof. The dipping utensil includes a frame member defining an opening. A tong member is engaged to the handle and is rotatable with respect to the handle between open and closed positions. The tong includes an actuation lever at one end and a gripping surface on a second end, whereby the gripping surfaces of the handle and tong may cooperate to hold an item placed therebetween.

12 Claims, 3 Drawing Sheets

COMBINATION BREADING TONGS AND DIPPING TOOL

BACKGROUND OF THE INVENTION

This invention relates to a combination tongs and dipping tool.

SUMMARY OF THE INVENTION

A combined tongs and dipping tool is described herein. The details of the invention are set forth below in connection with the detailed description of the embodiments.

DETAILED DESCRIPTION OF THE DRAWINGS

Figure 1:
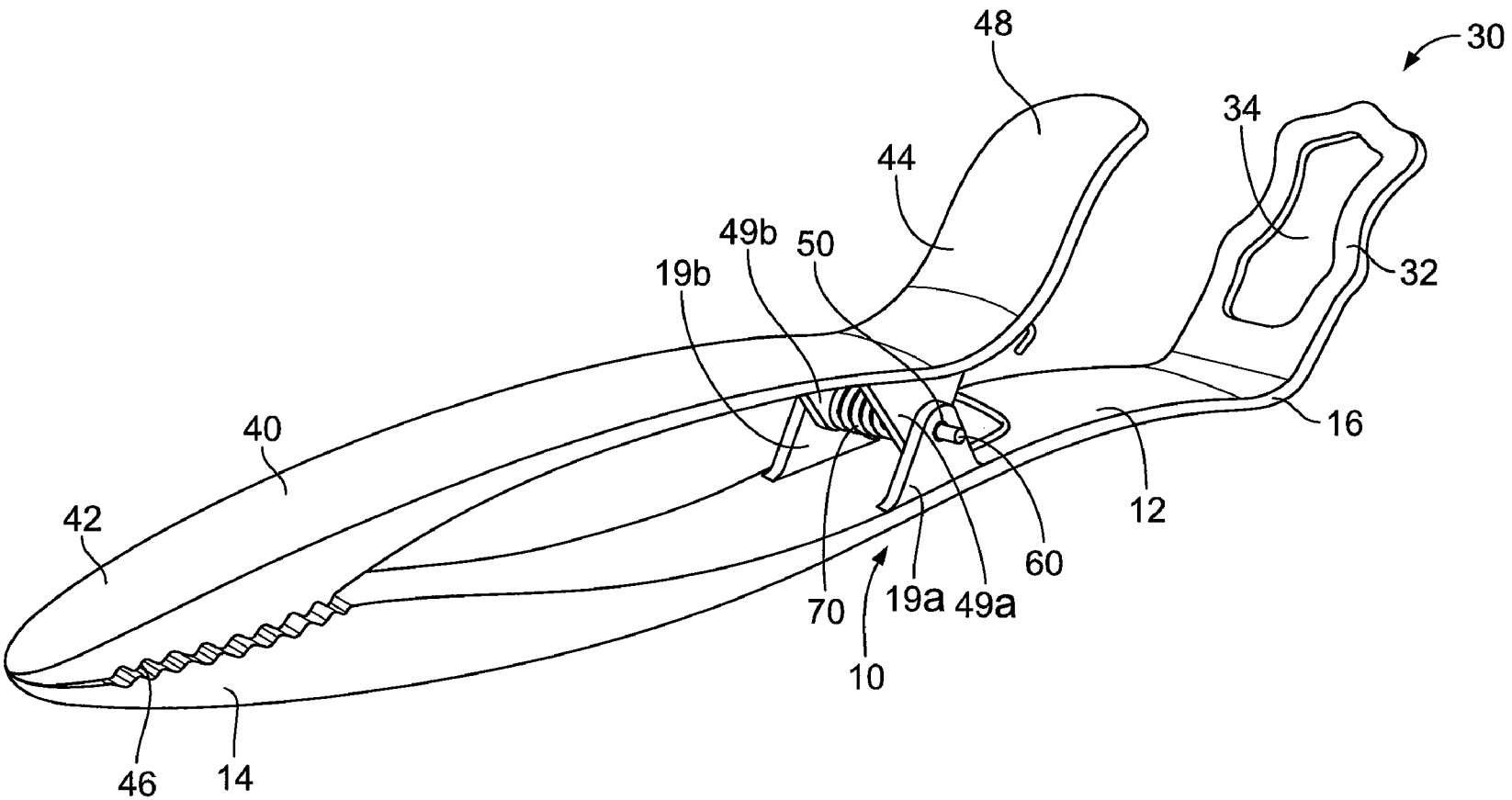
FIG. 1 is a perspective view of a first embodiment of the present invention, with the tong members in the closed position as described in detail below.

The present invention is described herein with respect to exemplary kitchen utensil 10, which is shown in FIG. 1. It will be understood that other kitchen utensils and applications can be used in accordance with the present invention.

In the depicted embodiment, kitchen utensil 10 comprises handle member 12, which comprises first end 14 and second end 16. First end 14 of handle member 12 forms first gripping surface 18, which is used in the tong function of kitchen utensil 10 as described in detail below.

Figure 4:
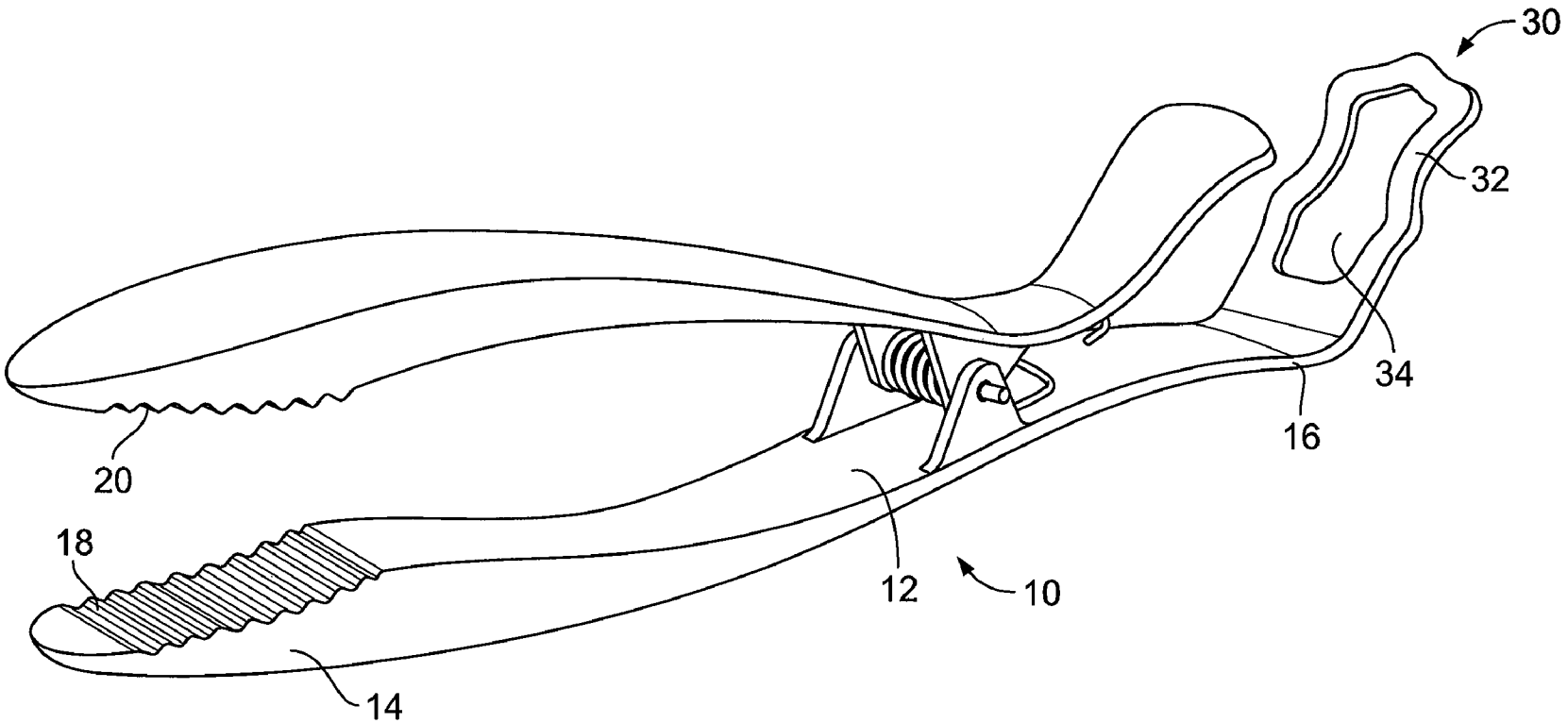
FIG. 4 is a perspective view of the first embodiment of the present invention, with the tong members in the open position as described in detail below.

In order to provide kitchen utensil 10 with a gripping function, utensil 10 may further comprise tong arm 40, which comprises a first end 42 and a second end 44. As seen in FIG. 4, first end 42 comprises second gripping surface 46, for the gripping purpose of kitchen utensil 10, and second end 44 comprises an actuation lever 48.

It will be appreciated by those in the art that while the current invention comprises many functions, two of those functions are prominent: a holding function and a gripping function. Thus, the disclosed invention provides a single tool which enables the user to perform multiple tasks, eliminating the need for multiple tools and thereby reducing clutter and cost. When utilizing the holding function of utensil 10, the user may use utensil 10 along with a dipping receptacle (not shown). The dipping receptacle is intended to be a bowl or similar item, such as for use in fondues and the like. The dipping receptacle may be made of any type of material, and may contain a liquid of some sort therein. The liquid may be hot or cold, depending on the type of material used for the dipping receptacle. In order to provide the user the ability to dip a desired food article into a dipping receptacle, dipping utensil 30 may be attached to second end 16 of handle member 12. In the depicted embodiment, dipping utensil 30 comprises a frame 32, which defines an opening 34 having a size and shape appropriate to hold a bite-size food item.

As seen in the depicted embodiment, dipping utensil 30 may be integrally formed with handle member 12. However, it is within the scope of the present invention that dipping tool 30 may be attached to handle member 12 by snaps, a tongue-in-groove arrangement, or other known means. Dipping tool 30 is depicted formed at an angle with respect to handle member 12.

When utilizing the holding function of kitchen utensil 10, the user grasps both first end 14 of handle member 12 and first end 42 of tong member 40 and places a food item (not shown) in opening 34, or, if suitable, attaches a food item to frame 32. The user then lowers both dipping utensil 30 and the food item into a liquid (not shown) that is contained within the dipping receptacle. Because dipping utensil 30 is formed at an angle with respect to handle member 12, if the dipping receptacle is very narrow, or if there is a large distance between the surface of the liquid and the top of the dipping receptacle, the user may still utilize kitchen utensil 10, and dip the food item and dipping utensil 30 into the liquid without getting any of the liquid on the user's hand.

By way of example, and in no way limiting, in order to cover a strawberry with chocolate, the user may place a strawberry on dipping utensil 30, resting the strawberry on frame 32. The user may then submerge both the strawberry and dipping utensil 30 into a liquid, such as melted chocolate, that is contained in the dipping receptacle. When the strawberry is sufficiently coated, the user may remove the strawberry and dipping utensil 30 from the liquid, and move the strawberry to a different location, to allow the liquid to solidify.

It will be appreciated by those in the art that dipping utensil 30 may not be appropriate for certain types of food items or for certain types of food preparations. By way of example, and in no way limiting, dipping utensil 30 would be inappropriate if the user wished to bread a chicken breast. Therefore, utensil 10 may be further equipped with a gripping function. It will further be appreciated by those in the art that the gripping function of utensil 10 may, like dipping utensil 30, be used with a dipping receptacle, which may be identical to the dipping receptacle described above, or may be different, depending on the food item being used, the required contents of the dipping receptacle or the purpose for which the tong function is being used.

In the depicted embodiment, tong member 40 is hingedly connected to handle member 12 by means of hinge members 49*a* and 49*b*, which may be integrally formed with, and extend from, tong member 40. Likewise, hinge members 19*a* and 19*b* may be integrally formed with, and extend from, handle member 12. Each hinge member 19*a*, 19*b*, 49*a* and 49*b* comprises a hole 50 (not shown).

Hinge bar 60 extends through each of the hinge members 49*a*, 49*b*, 19*a* and 19*b* and cooperates with biasing spring 70 to provide the hinge connection. Other means of connecting tong member 40 to handle member 12 are well known, and it will be obvious to those in the art that any such means can be used in place of the depicted hinge.

Tong member 40 is rotatable with respect to handle member 12 between a first, closed position, shown in FIG. 1, and a second, open position, shown in FIG. 4. In the depicted embodiment, biasing spring 70 is disposed about hinge bar 60 and engaged to both tong member 40 and handle member 12 to bias handle member to the first position. However, it will be appreciated by those in the art that a biasing spring may be engaged to both tong member 40 and handle member 12 in any manner sufficient to bias tong member 40 to the first, closed position.

Figure 2:
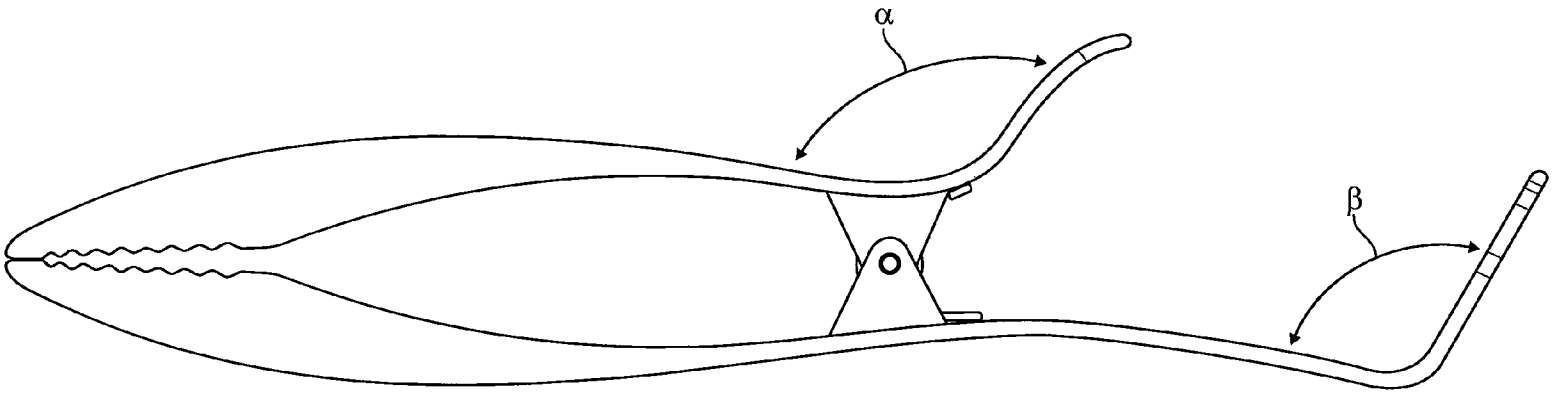
FIG. 2 is a first side view of the embodiment of the present invention depicted in FIG. 1.
Figure 3:
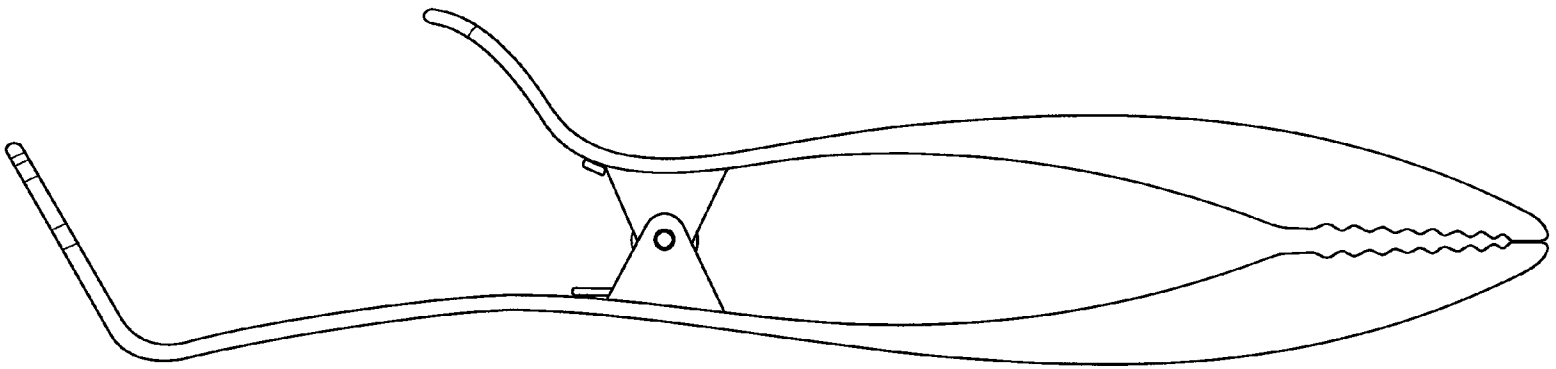
FIG. 3 is a second side view of the embodiment of the present invention depicted in FIG. 1, opposite the side view depicted in FIG. 2.

As seen in FIGS. 2 and 3, actuation lever 48 is formed at a first angle $\alpha$ with respect to tong member 40. When tong member 40 is moved to the second position, actuation lever 48 contacts handle member 12 to prevent further rotation. Because of this contact, the distance between gripping portions 46 and 18 when tong member 40 is in the second position directly coincides with the first angle α at which actuation lever 48 extends from handle member 12.

As further seen in FIGS. 2 and 3, dipping utensil 30 extends from handle member at a second angle β. In the depicted embodiment, the difference between first angle α and second angle β is very slight, for example, less than 5 degrees, and dipping utensil 30 extends nearly parallel with actuation lever 48. However, it will be appreciated by those in the art that the scope of the present invention includes those embodiments in which the difference between the first angle α and second angle β is much greater.

When utilizing the gripping function of kitchen utensil 10, the user grasps handle member 12 near second end 16. The user will then depress actuation lever 48 to move tong member 40 from the first position to the second position. When in the second position, the user will place gripping portions 46 and 18 about the food item and release actuation member 48. Biasing spring 70 will then bias tong member 40 to the first position, clamping down on the food item, and allowing the user to wield the food item as desired.

By way of example, and in no way limiting, in order to bread a chicken breast, the user will grip the chicken breast with gripping portions 46 and 18. The user may then pick up the chicken breast and move it to the dipping receptacle, which will be filled with the appropriate materials. The user may then use gripping portions 46 and 18 to manipulate the chicken breast until it is sufficiently covered. The user may then use utensil 10 to move the now-coated chicken breast as needed.

While specific configurations of the invention have been described in detail, it will be appreciated by those skilled in the art that various modifications and alternatives to those details could be developed in light of the overall teachings of this disclosure. The particular arrangements disclosed herein a meant to be illustrative only and not limited as to the scope of the invention which is to be given the full breadth of the appended claims and any equivalents thereof.

The invention claimed is:

1. A kitchen utensil comprising:

a handle member, comprising a first end, forming a first gripping surface, and a second end;

a dipping utensil engaged to the second end of the handle member and extending at a first angle therefrom, the dipping utensil comprising a frame member defining an opening having a periphery;

a tong member engaged to the handle member, and rotatable about an axis of rotation with respect to the handle member between a first, closed position and a second, open position, the tong member having a first end, forming a second gripping surface, and a second end, and wherein the axis of rotation is parallel to a plane formed by the periphery of the opening; and an actuation lever formed on the second end of the tong member, the actuation lever positioned entirely between the first and second ends of the handle member and having a length such that it does not extend past any portion of the dipping utensil;

wherein the first gripping surface and the second gripping surface cooperate to grasp any item placed therebetween.

2. The kitchen utensil as set forth in claim 1, further comprising a biasing spring engaged to the handle member and the tong member, wherein the biasing spring biases the tong member to the first, closed position.

3. The kitchen utensil as set forth in claim 2, wherein the actuation lever extends at a second angle from the tong member.

4. The kitchen utensil as set forth in claim 3, wherein the actuation lever is integrally formed from the tong member.

5. The kitchen utensil as set forth in claim 3, wherein the difference between the first angle and the second angle is less than 5 degrees.

6. The kitchen utensil as set forth in claim 1, wherein the dipping utensil is integrally formed form the second end of the handle member.

7. The kitchen utensil as set forth in claim 1, further comprising first and second hinge members extending from the tong member, and third and fourth hinge members extending from the handle member, wherein the first and second hinge member cooperate with the third and fourth hinge members, respectively, to hingedly connect the tong member to the handle member.

8. The kitchen utensil as set forth in claim 7, wherein a hinge bar is engaged to each of the hinge members.

9. A kitchen utensil comprising:

a handle member comprising a first end and a second end;

a first gripping surface formed on the first end of the handle member;

a dipping utensil engaged to the second end of the handle member, the dipping utensil formed at a first angle with respect to the handle member;

a tong member hingedly engaged to the handle member, the tong member comprising a first end and a second end and rotatable with respect to the handle member between a closed position and an open position;

a second gripping surface formed on the first end of the tong member;

an actuation lever engaged to the second end of the tong member, the actuation lever positioned entirely between the first and second ends of the handle member and having a length such that it does not extend past any portion of the dipping utensil, and formed at a second angle with respect to the tong member; and a biasing spring engaged to the handle member and the tong member, the biasing spring biasing the tong member to the closed position.

10. The kitchen utensil as set forth in claim 9, wherein the difference between the first angle and the second angle is less than 5 degrees.

11. A utensil comprising:

a handle member comprising a first end and a second end;

a first gripping surface formed on the first end of the handle member;

a dipping utensil engaged to the second end of the handle member, the dipping utensil formed at a first angle with respect to the handle member;

a tong member hingedly engaged to the handle member, the tong member comprising a first end and a second end and rotatable with respect to the handle member between a closed position and an open position;

a second gripping surface formed on the first end of the tong member;

an actuation lever engaged to the second end of the tong member, the actuation lever formed at a second angle with respect to the tong member; and a biasing spring engaged to the handle member and the tong member, the biasing spring biasing the tong member to the closed position;

wherein the difference between the first angle and the second angle is less than 5 degrees.

12. A kitchen utensil comprising:

a handle member comprising a first end and a second end;

a first gripping surface formed on the first end of the handle member;

a dipping utensil engaged to the second end of the handle member, the dipping utensil formed at a first angle with respect to the handle member and comprising a frame member defining an opening having a periphery;

a tong member hingedly engaged to the handle member, the tong member comprising a first end and a second end and rotatable about an axis of rotation with respect to the handle member between a closed position and an open position, and wherein the axis of rotation is parallel to a plane formed by the periphery of the opening;

a second gripping surface formed on the first end of the tong member;

an actuation lever engaged to the second end of the tong member, the actuation lever positioned entirely between the first and second ends of the handle member and having a length such that it does not extend past any portion of the dipping utensil, and formed at a second angle with respect to the tong member; and a biasing spring engaged to the handle member and the tong member, the biasing spring biasing the tong member to the closed position.

* * * * *